US007494327B2

(12) United States Patent
Etter et al.

(10) Patent No.: US 7,494,327 B2
(45) Date of Patent: Feb. 24, 2009

(54) PORTABLE AIR COMPRESSOR HAVING STORAGE COMPARTMENT

(75) Inventors: Mark A. Etter, Humboldt, TN (US); J. Cody Stilwell, Jackson, TN (US); Jeff Brian Thompson, Jackson, TN (US); Gary D. White, Medina, TN (US)

(73) Assignee: Black & Decker Inc., Newark, DE (US)

( * ) Notice: Subject to any disclaimer, the term of this patent is extended or adjusted under 35 U.S.C. 154(b) by 749 days.

(21) Appl. No.: 10/812,235

(22) Filed: Mar. 29, 2004

(65) Prior Publication Data

US 2006/0102261 A1 May 18, 2006

Related U.S. Application Data

(60) Provisional application No. 60/458,774, filed on Mar. 28, 2003.

(51) Int. Cl.
*F04B 53/00* (2006.01)

(52) U.S. Cl. ..... 417/234

(58) Field of Classification Search ..... 417/234
See application file for complete search history.

(56) References Cited

U.S. PATENT DOCUMENTS 4,187,058 A * 2/1980 Fish ..... 417/234
4,389,166 A 6/1983 Harvey et al. ..... 417/234
4,715,787 A * 12/1987 Hung ..... 417/234
4,789,310 A * 12/1988 Hung ..... 417/234
4,830,579 A 5/1989 Cheng ..... 417/234
6,099,222 A * 8/2000 Moore ..... 410/117
6,120,077 A * 9/2000 Westphal et al. ..... 296/37.13
6,146,108 A 11/2000 Mullendore ..... 417/234
6,468,049 B1 * 10/2002 Hung ..... 417/234
2005/0191187 A1 * 9/2005 Vos et al. ..... 417/234

OTHER PUBLICATIONS

*"Compressors; 12 Volt Air Compressor"*; http://www.allenmachineco.com/pages/data/comp-3.htm; Mar. 28, 2003; 2 pages.

* cited by examiner

*Primary Examiner*—Michael Koczo, Jr.
(74) *Attorney, Agent, or Firm*—Michael P. Leary; Charles E. Yocum; Adan Ayala

(57) ABSTRACT

The present invention is directed to a portable air compressor having a storage compartment, which may be used to store air compressor accessories. A shroud which encloses a portable air compressor has a recess. The recess is at least partially covered with a cover member, which is mounted to the shroud. The recess and the cover member together define a storage compartment for storing air compressor accessories such as fittings, nozzles, and the like, and/or tools such as a wrench, or the like.

10 Claims, 5 Drawing Sheets

PORTABLE AIR COMPRESSOR HAVING STORAGE COMPARTMENT

CROSS-REFERENCE TO RELATED DOCUMENTS

The present application claims the benefit under 35 U.S.C. § 119(e) of U.S. Provisional Patent Application Ser. No. 60/458,774, entitled "Portable Air Compressor Having Storage Compartment," filed Mar. 28, 2003. Said U.S. Provisional Patent Application Ser. No. 60/458,774 is herein incorporated by reference in its entirety.

FIELD OF THE INVENTION

The present invention relates generally to the field of air compressors, and more particularly to a portable air compressor including a storage compartment.

BACKGROUND OF THE INVENTION

Portable air compressors, because of their mobility, are widely used in household and industrial applications for operating air powered tools such as fasteners, socket driving tools, material shapers, sanders, sprayers, inflation chucks, and the like. Operators often utilize portable air compressors with various accessories such as fittings, nozzles, or the like for operating air powered tools. However, since these accessories are detachable and normally stored separately from portable air compressors, the accessories may become lost, and actual operational difficulties may arise. For example, it is not uncommon for an operator to first transport a portable air compressor for a long distance to a worksite and then to realize that he/she is not able to perform the desired operation because he/she has forgot to bring the desired accessory to the worksite. This may cause great frustration for the operator. Moreover, the benefit of the mobility of the portable air compressor may be offset by the operator's inability to access the desired accessory.

Consequently, it would be desirable to provide a portable air compressor including a storage compartment capable of storing accessories such as fittings, nozzles, and the like.

SUMMARY OF THE INVENTION

Accordingly, the present invention is directed to a portable air compressor having a storage compartment, which may be used to store air compressor accessories. According to one aspect of the present invention, a shroud which encloses a portable air compressor has a recess. The recess is at least partially covered with a cover member that is mounted to the shroud using a frame member. The recess and the cover member may define a storage compartment for storing air compressor accessories such as fittings, nozzles, and the like, and/or tools such as a wrench, or the like. The cover member may include at least one tab, which may be inserted into the opening of the shroud to help secure the cover member to the shroud. According to a further aspect of the present invention, a portable air compressor includes a flexible storage compartment for storing air compressor accessories such as fittings, nozzles, and the like, and/or tools such as a wrench, or the like. The flexible storage compartment may be securely attached to a handle of a shroud of the portable air compressor. Alternatively, the flexible storage compartment is mounted to a shroud of the portable air compressor.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
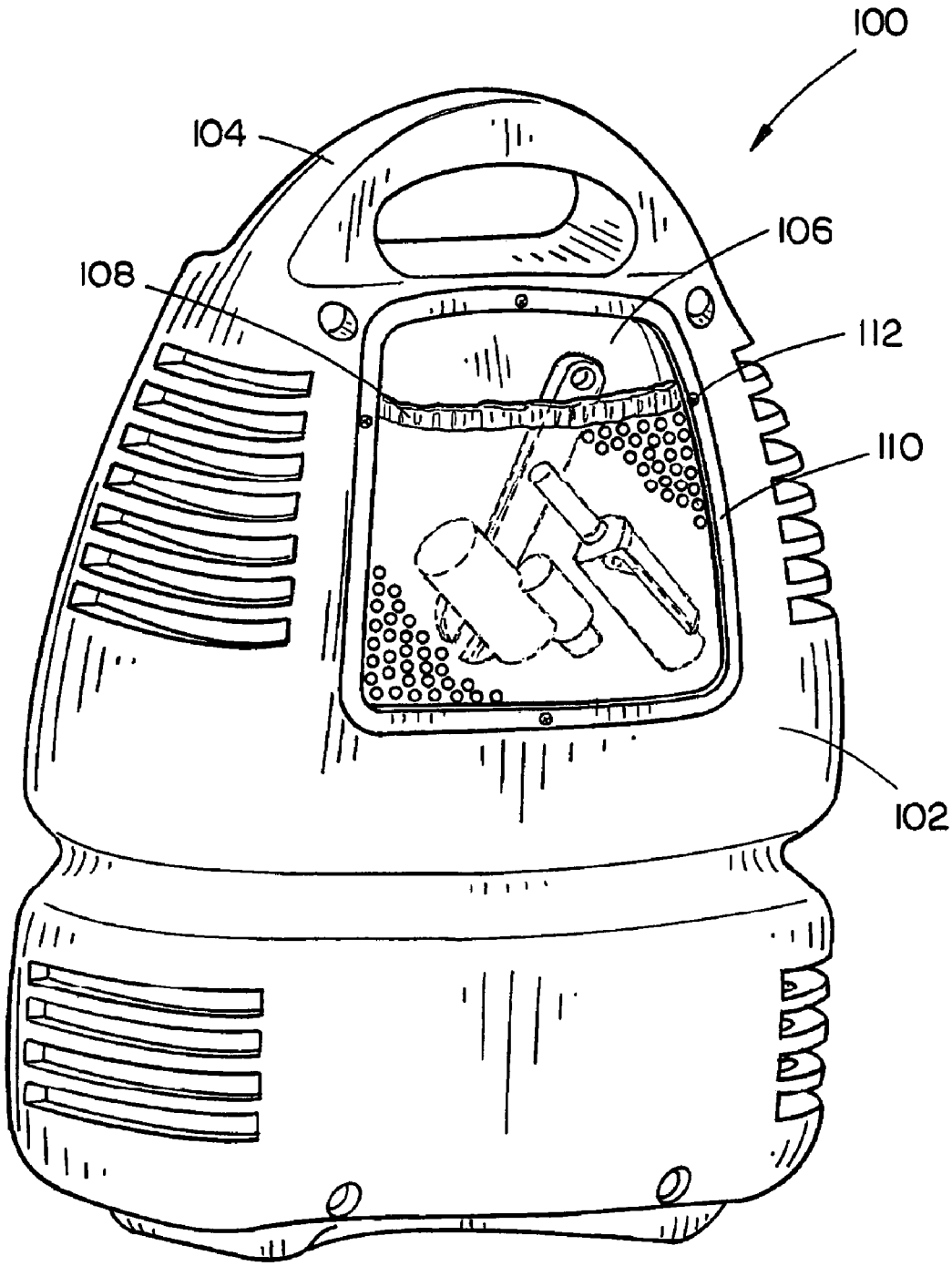
FIG. 1 is a side elevational view of an exemplary portable air compressor having a storage compartment in accordance with the present invention.
Figure 2:
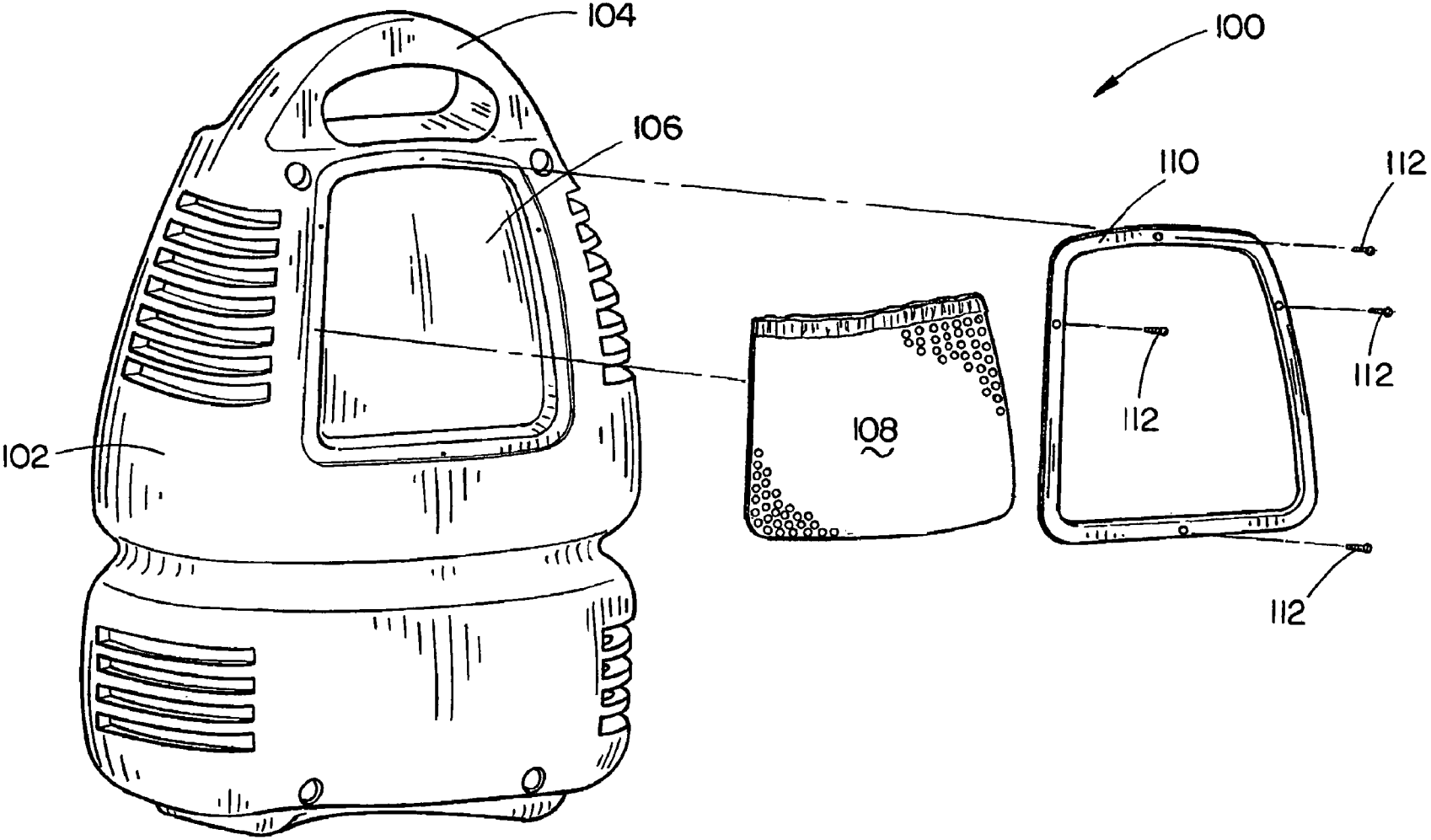
FIG. 2 is an exploded view of the storage compartment of the air compressor shown in FIG. 1.

Referring generally to FIGS. 1 and 2, an air compressor 100 having a storage compartment in accordance with an exemplary embodiment of the present invention is shown. The portable air compressor 100 may include a compressor (not shown) for supplying compressed air, and a manifold assembly (not shown) for controlling and distributing compressed air from the portable air compressor 100 to one or more air powered tools. The portable air compressor 100 may have a shroud or housing 102, which encloses the compressor and the manifold assembly. The shroud 102, which is preferably formed of plastic, may include a handle 104 for allowing an operator to lift and transport the portable air compressor 100 between worksites.

As shown in FIGS. 1 and 2, the shroud 102 may include a recess 106. The recess 106 may be at least partially covered with a cover member 108. The cover member 108 may be mounted to the shroud 102 using a frame member 110. Using fasteners 112 such as screws, bolts, and the like, the frame member 110 and the cover member 108 may be secured to the shroud 102 and may, along with the recess 106, form a storage compartment therein. The storage compartment is preferably configured for storing air compressor accessories such as fittings, nozzles, and the like, and/or tools such as a wrench, or the like.

In one exemplary embodiment of the present invention, the cover member 108 is made of fabric. For example, the cover member 108 may be a net or web made of knit fabrics made from durable materials such as nylon thread, and the like, and may have small holes that are of sufficient size to capture small parts such as athletic ball pump needles, and the like. In another exemplary embodiment of the present invention, the cover member 108 may be made of plastic. For example, the cover member 108 may be made of transparent plastic, allowing an operator to visually see the contents of the storage compartment from outside the compartment and/or preventing small parts from falling out.

Those of ordinary skill in the art will appreciate that various combinations and arrangements may be employed without departing from the scope and spirit of the present invention. Alternatively, the cover member 108 may be mounted to the shroud 102 via the fasteners 112, or via an adhesive material (i.e., glue) without departing from the scope and spirit of the present invention. Moreover, instead of partially covering the recess 106, the cover member 108 may cover the recess 106 entirely and may have a closure device such as a zipper, or the like, installed thereof for allowing an operator to have access to the contents of the storage compartment.

Figure 3:
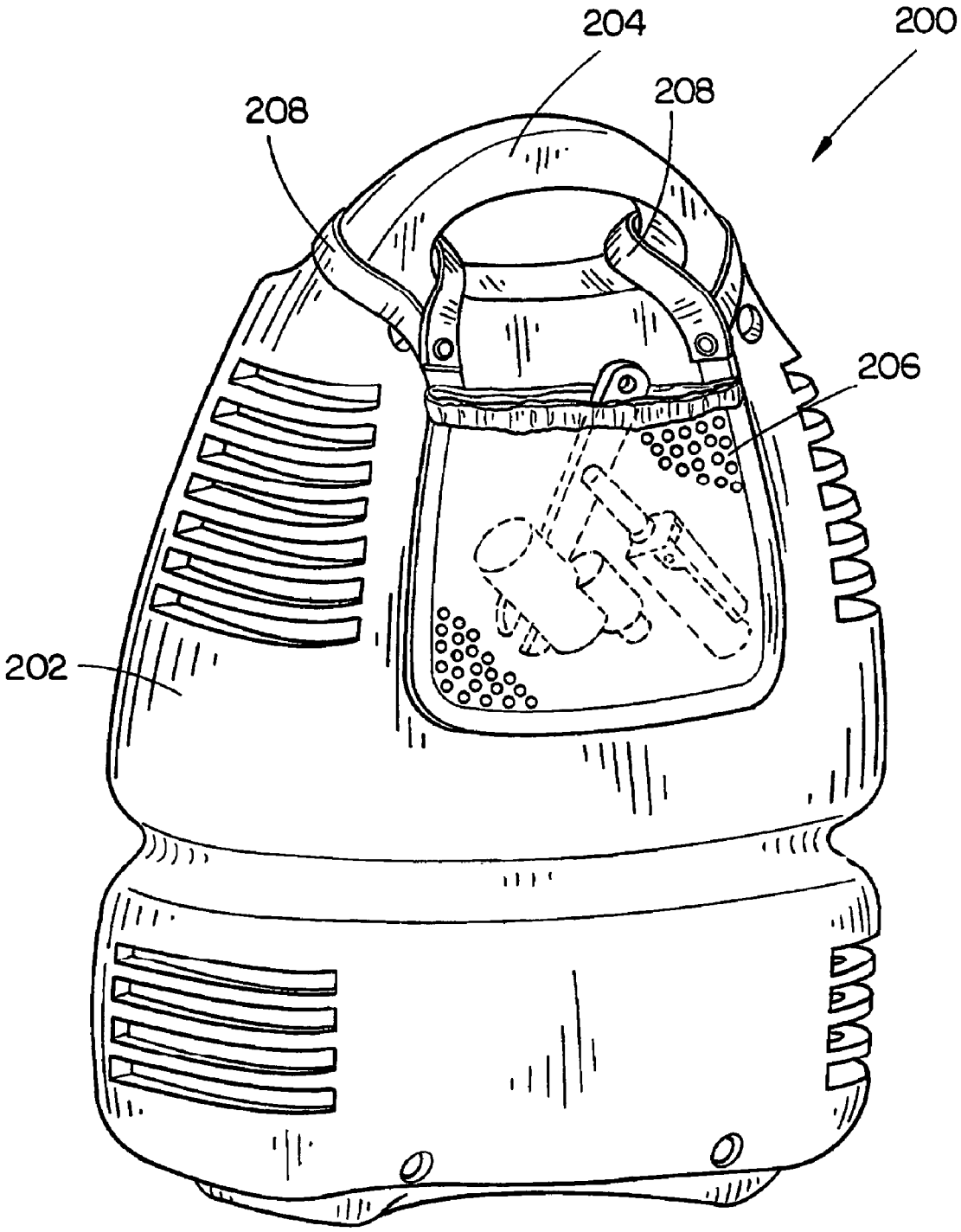
FIG. 3 is a side elevational view of an additional exemplary portable air compressor having a storage compartment in accordance with the present invention.

Referring now to FIG. 3, an exemplary portable air compressor 200 having a storage compartment in accordance with the present invention is shown. The portable air compressor 200 may include a compressor for supplying compressed air, and a manifold assembly for controlling and distributing compressed air from the portable air compressor 200 to one or more air powered tools. The portable air compressor 200 may have a shroud or housing 202, which encloses the compressor and the manifold assembly. The shroud 202, which is preferably formed of plastic, may include a handle 204, allowing an operator to lift and transport the portable air compressor 200 between worksites.

The air compressor 200 may include a flexible storage compartment 206 such as a bag or the like securely attached to the handle 204, which may be strong enough to store air compressor accessories such as air nozzles, and the like, and/or tools such as a wrench, or the like. In one exemplary embodiment of the present invention, the flexible storage compartment 206 may be made of fabric. For example, the flexible storage compartment 206 may be made of knit fabrics made from durable materials such as nylon thread, and the like. The flexible storage compartment 206 may have small holes that are of sufficient size to capture small parts such as athletic ball pump needles, and the like. In another exemplary embodiment of the present invention, the flexible storage compartment 206 may be made of plastic. For example, the flexible storage compartment 206 may be made of transparent plastic, allowing an operator to visually see the contents of the storage compartment from outside the compartment. It is understood that the flexible storage compartment 206 may be made of various materials as contemplated by those of ordinary skill in the art without departing from the scope and spirit of the present invention.

The flexible storage compartment 206 may be securely attached to the handle 204 as shown in FIG. 3. For example, the flexible storage compartment 206 may include straps 208 configured to engage both sides of the handle 204. The straps 208 may be spaced apart so that an operator may grasp the handle 204 without touching the straps 208. This way, the flexible storage compartment 206 may not interfere with lifting and/or transporting of the air compressor 200. Alternatively, the flexible storage compartment 206 may be mounted to the handle 204 using the fasteners 112 shown in FIGS. 1 and 2, and/or using an adhesive material.

Figure 4:
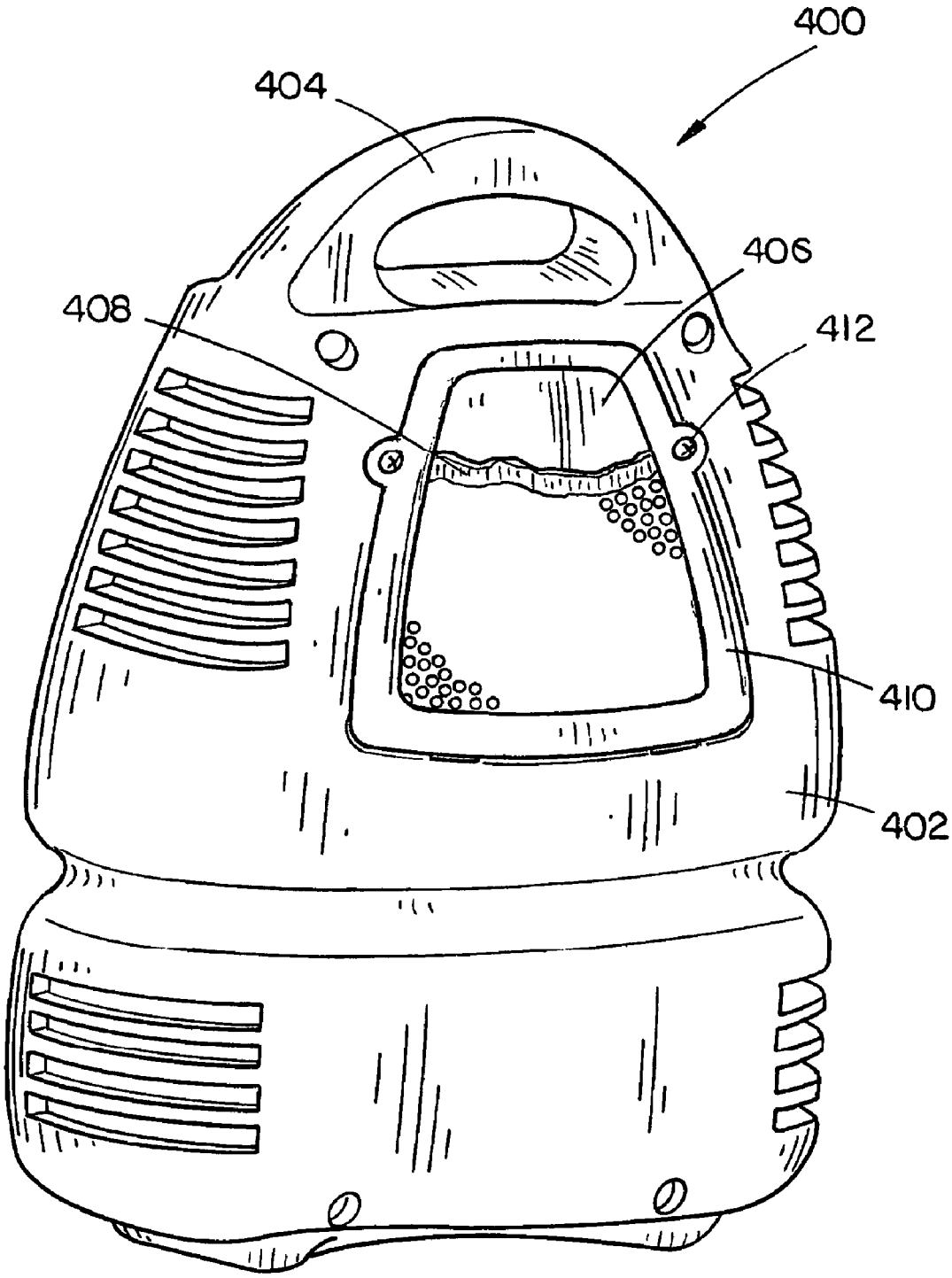
FIG. 4 is a side elevational view of a further exemplary portable air compressor having a storage compartment in accordance with the present invention.
Figure 5B:
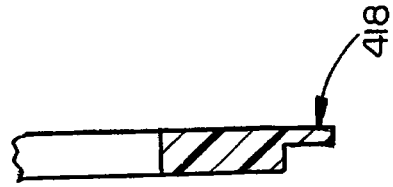
FIG. 5B shows a cross-sectional view of the tab shown in FIG. 5A.
Figure 5A:
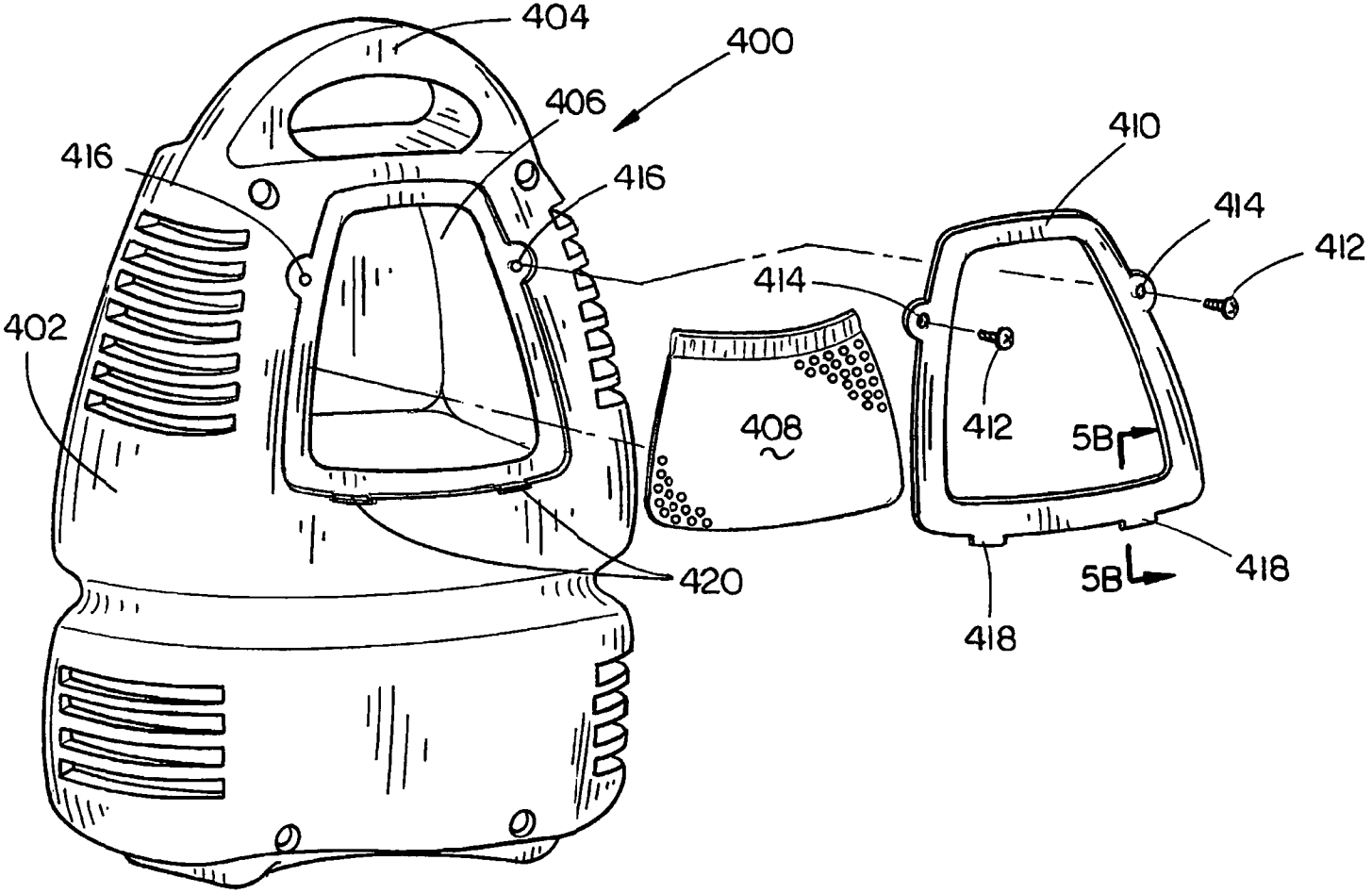
FIG. 5A shows an exploded view of the storage compartment of the air compressor shown in FIG. 4.

Referring generally now to FIGS. 4, 5A and 5B, an air compressor 400 having a storage compartment in accordance with an exemplary embodiment of the present invention is shown. The portable air compressor 400 may include a compressor for supplying compressed air and a manifold assembly for controlling and distributing compressed air from the portable air compressor 400 to one or more air powered tools. The portable air compressor 400 may have a shroud or housing 102, which encloses the compressor and the manifold assembly. The shroud 102, which is preferably formed of plastic, may include a handle 404 for allowing an operator to lift and transport the portable air compressor 400 between worksites.

As shown in FIGS. 4, 5A and 5B, the shroud 402 may include a recess 406. The recess 406 may be partially covered with a cover member 408. The cover member 408 may be mounted to the shroud 402 using a frame member 410. The frame member 410 may include a plurality of openings 414, through which fasteners 412 such as screws, bolts, and the like may be inserted into corresponding openings 416 in the shroud 402 to mount the frame member 410 and the cover member 408 to the shroud 402. In a preferred embodiment, the frame member 410 includes at least one tab 418 (see FIG. 5B for a cross-sectional view). When mounting the frame member 410 and the cover member 408 to the shroud 402, the tab 418 may be first inserted into the corresponding opening 420 in the shroud 402, and then the fasteners 412 may be inserted into the openings 414 and 416. This way, the frame member 410 and the cover member 408 may be securely attached to the shroud 402 and, along with the recess 406, form a storage compartment therein. The storage compartment may be used to store air compressor accessories such as fittings, nozzles, and the like, and/or tools such as a wrench, or the like.

In one exemplary embodiment of the present invention, the cover member 408 may be made of fabric. For example, the cover member 408 may be a net or web made of knit fabrics made from durable materials such as nylon thread, and the like, and may have small holes that are of sufficient size to capture small parts such as ball pump needles, and the like. In another exemplary embodiment of the present invention, the cover member 408 may be made of plastic. For example, the cover member 408 may be made of transparent plastic, allowing an operator to visually see the contents of the storage compartment from outside the compartment. It is understood that the cover member 408 may be made of any material as may be contemplated by those of ordinary skill in the art without departing from the scope and spirit of the present invention A portable air compressor having a storage compartment in accordance with the present invention makes it possible to transport the portable air compressor together with air compressor accessories such as fittings, nozzles, and the like, and/or tools such as a wrench, or the like. Thus, after being transported to a new worksite, the air compressor is available for immediate operation without waiting for the arrival of air compressor accessories since the portable air compressor and the air compressor accessories are transported together.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A portable air compressor having a storage compartment, comprising:

a compressor for supplying compressed air;

a shroud enclosing said compressor, said shroud having a recess;

a frame member at least partially surrounding the recess;

a cover member at least partially covering said recess, said frame member and said cover member are mounted to said shroud through a fastener, and wherein said cover member and said recess define a storage compartment.

2. The portable air compressor of claim 1, wherein said shroud is made of plastic.

3. The portable air compressor of claim 1, wherein said shroud includes a handle.

4. The portable air compressor of claim 1, wherein said cover member is made of fabric.

5. The portable air compressor of claim 4, wherein said fabric is made from nylon thread.

6. The portable air compressor of claim 1, wherein said cover member is made of plastic.

7. The portable air compressor of claim 6, wherein said plastic is transparent.

8. The portable air compressor of claim 1, wherein said cover member is mounted to said shroud using an adhesive material.

9. The portable air compressor of claim 1, wherein said fastener is at least one of a screw and a bolt.

10. The portable air compressor of claim 1, wherein said frame member includes at least one tab, said at least one tab being inserted into at least one opening of said shroud for helping secure said frame member and said cover member to said shroud.

* * * * *